US005467954A

United States Patent [19]

Wekell

[11] Patent Number: 5,467,954

[45] Date of Patent: Nov. 21, 1995

[54] TRACK MOUNTING SYSTEM FOR ELECTRONIC DEVICES

[75] Inventor: William O. Wekell, Renton, Wash.

[73] Assignee: SpaceLabs Medical, Inc., Redmond, Wash.

[21] Appl. No.: 180,675

[22] Filed: Jan. 13, 1994

[51] Int. Cl.[6] ..... A47B 67/02

[52] U.S. Cl. ..... 248/201; 248/246; 248/247; 248/222.11; 312/242; 312/247

[58] Field of Search ..... 248/220.2, 221.3, 248/221.4, 222.2, 225.1, 243, 244, 245, 246, 247, 222.1, 300, 201; 211/94, 94.5, 103; 312/242, 245, 247

[56] References Cited

U.S. PATENT DOCUMENTS

| | | | |
|---|---|---|---|
| 1,055,201 | 3/1913 | Mason | 248/222.2 X |
| 3,429,540 | 2/1969 | Worrallo | 248/246 |
| 4,040,588 | 8/1977 | Papsco et al. | 248/246 X |
| 4,170,335 | 10/1979 | King | 248/246 |
| 4,733,841 | 3/1988 | Wilson | 248/222.1 |
| 5,318,264 | 6/1994 | Meiste | 248/246 X |

FOREIGN PATENT DOCUMENTS

| | | | |
|---|---|---|---|
| 234585 | 5/1911 | Germany | 248/246 |
| 2216397 | 10/1989 | United Kingdom | 248/246 |

*Primary Examiner*—Ramon O. Ramirez
*Assistant Examiner*—Derek J. Berger
*Attorney, Agent, or Firm*—Seed and Berry

[57] ABSTRACT

A track mounting system for mounting electronic devices is described. The mounting system includes a mounting plate having a pair of tracks extending forwardly and a pair of mounting brackets to which a device is attached. The mounting brackets include sidewardly extending mounting fingers which engage inner surfaces of the tracks to lock the brackets to the tracks by forcing edges of the mounting fingers to "bite" into the inner surfaces of the tracks. The edges of the mounting fingers are biased into the inner surfaces of the tracks by force from a tensioning arm which is flexed as the device is rotated into its mounting position. The device and brackets are retained in their alignment orientation by retaining tabs which engage the tracks. To ease alignment of the mounting brackets to the tracks, a guide extension extends from the mounting brackets and is curved sidewardly to guide the brackets into their alignment position as a device is rotated into its mounting position. The mounting plate includes a pair of secondary tracks having a groove therebetween to which a cable retainer clip attaches. The cable retainer clip and groove together provide a passageway for cables to pass behind the mounted device to be concealed from view.

16 Claims, 6 Drawing Sheets

TRACK MOUNTING SYSTEM FOR ELECTRONIC DEVICES

TECHNICAL FIELD

The present invention relates to mounting systems for electronic devices, and more particularly to track mounts for mounting devices on a wall or similar vertical structure.

BACKGROUND OF THE INVENTION

Electronic devices are used in many applications. In some applications, however, the physical presence of the electronic devices may obstruct access to people or things. For example, in medical applications, medical electronic devices with their accompanying cabling may impede access to a patient or block traffic flow through a confined area.

While some reduction of this obstruction may be achieved by positioning the electronic on fixed shelves or mobile carts, each of these approaches has significant drawbacks. Shelves extend outwardly from walls, blocking access even when no electronic device is present. While this problem may be reduced by mounting the shelf high upon a wall, access to electronic devices in such an elevated position may be difficult and cause delays in accessing and activating such devices. In particular, in medical electronic devices, such delays may cause delays in providing medical attention where time is of the essence.

Although electronic devices mounted upon mobile carts provide easier access to the electronic devices, such carts often block important walkways and other means of access. Once again, in medical applications, this impediment may be costly and/or life threatening.

A third alternative is to provide a mount on a wall within the environment in which the electronic device is to be used. However, it is disadvantageous to mount the electronic devices permanently to the wall. Returning once again to the example of the medical environment, electronic components for medical applications often must be interchanged between various locations quickly. In such environments, interchanges require the devices to be demounted from the first location and remounted in the second location, often very quickly.

To overcome the drawbacks of permanently affixed wall mounts, detachable wall mounting systems have been developed. Typical detachable wall mounting systems utilize a wall mounting base affixed to a wall with a catch mechanism for engaging the base. Such catch mechanisms usually incorporate levers or screws to secure the device to the base. Each of these mechanisms has significant drawbacks. Where screws are used, they must be tightened or loosened, either by hand or with a special tool such as a screwdriver. Use of tools is undesirable due to the possibility of them being misplaced or causing delays in mounting and demounting. Where hand tightening is used, care must be taken to ensure that the screws are sufficiently tight to maintain the device in its mounted position. Otherwise, the mounting may fail, causing damage to the devices and interrupting their operation. When binding occurs in hand tightened systems, critical delays may result. Also, when screws are used, care must be taken to prevent the threads from being crossed, making the device less secure and causing screws to bind.

Where a lever mechanism is employed, care must be taken to ensure that the lever is fully engaged. In high stress applications, such as medical environments, focus on this aspect detracts from attention to often critical tasks. Moreover, where a level system is employed, the electronic device structure must often be modified to provide access to engage and/or release the lever. This limits flexibility in design of electronic devices.

SUMMARY OF THE INVENTION

A track mounting system for mounting electronic devices to a wall includes a mounting plate for attachment to a wall with a pair of parallel tracks on a forward surface of the base. The tracks include a forwardly projecting leg rigidly affixed to a forward surface of the mounting plate and a transversely extending leg projecting from the forward edge of the forwardly projecting leg. A gap is thereby formed between the transversely extending leg and the forward surface of the mounting plate.

A pair of mounting brackets hold the electronic device to the mounting plate. Each of the mounting brackets includes a base portion to which the electronic device is mounted. A mounting finger integral to the base portion extends sidewardly into the gap to engage the tracks to maintain the vertical position of the mounting bracket and thus the electronic device.

Engagement of the mounting fingers to the tracks is maintained by rotational torque which causes inner and outer edges of the mounting finger to "bite" into the metal of the track. To maintain this force, the preferred embodiment of the invention includes a tensioning arm which is flexed as the device is rotated to is mounted position. The device is held in this rotated position, and the tensioning arm is retained in its flexed position, by a retaining tab at a lower end of each of the base portions which engages the track. The retaining tabs are releasable by pressing on a pushpad at a lower end of the mounting bracket.

The electronic device is mounted quickly by holding it in a mounting position where it is simultaneously at a forward angle with its lower end away from the wall and at a sideward angle with its lower end to one side of its upper end as viewed looking at the wall. In this position the mounting fingers may be inserted between the tracks. Then, the device is rotated sidewardly to move the mounting fingers into the gaps. The device is then pivoted to a fully upright position to flex the tensioning arms and engage the retaining tabs. The device is demounted by releasing the retaining tabs and rotating in two directions opposite those for mounting. As a failsafe, an endcap mounted at a lower end of the track prevents the electronic device from falling if the mounting fingers' engagement to the track should fail.

A cable retainer holds cables between the tracks by dipping to a pair of secondary tracks integral to the mounting plate between the tracks. The cable retainer and the secondary tracks provide a passageway behind the mounted devices where cables are concealed and kept orderly.

DETAILED DESCRIPTION OF THE INVENTION

Figure 1:
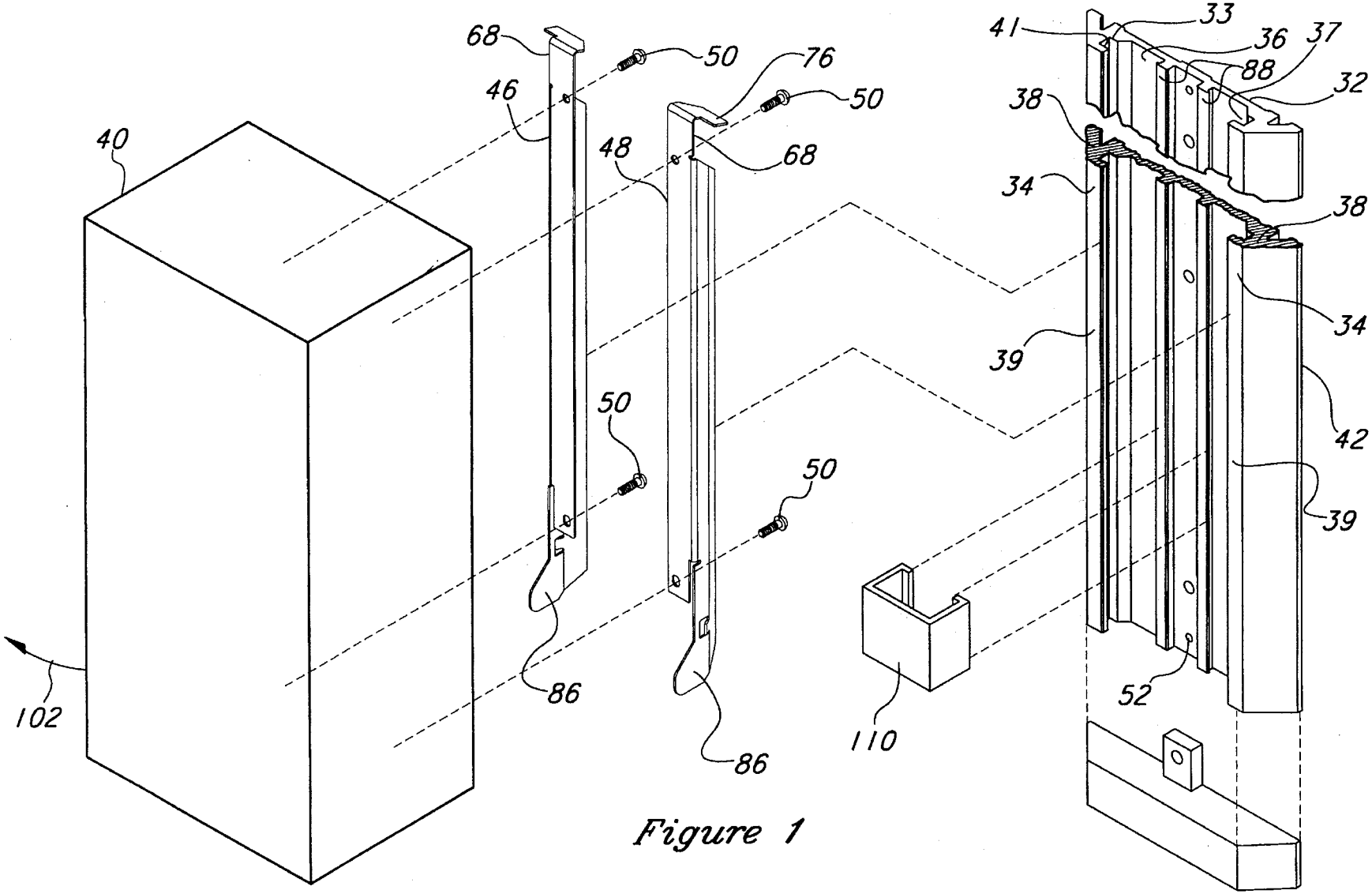
FIG. 1 is an exploded isometric view of a preferred embodiment of the invention.

As shown most clearly in FIG. 1, a mounting system including a mounting plate 42 and a pair of mounting brackets 46, 48 that support an electronic device 40 on a structure, such as a wall.

The mounting plate 42 is a longitudinal structure, preferably formed from a single piece of metal, typically aluminum, using known techniques, such as extrusion. An integral pair of tracks 34 extend forwardly from a forward surface 36 of the mounting plate to provide a structure, for the mounting brackets to engage. Each of the tracks 34 includes a forwardly extending leg 38 projecting from the forward surface 36 and a transversely extending leg 39 projecting from the forwardly extending leg 38. An inner surface 41 (FIG. 6) of the transversely extending leg 39 parallels the forward surface 36, leaving a gap 37. Surface portions 33 of the forward surface 36 beneath the transversely extending leg 39 are preferably elevated with respect to the remaining portions of the forward surface 36 to allow clearance for insertion and rotation of the mounting bracket as described hereinbelow.

Figure 7:
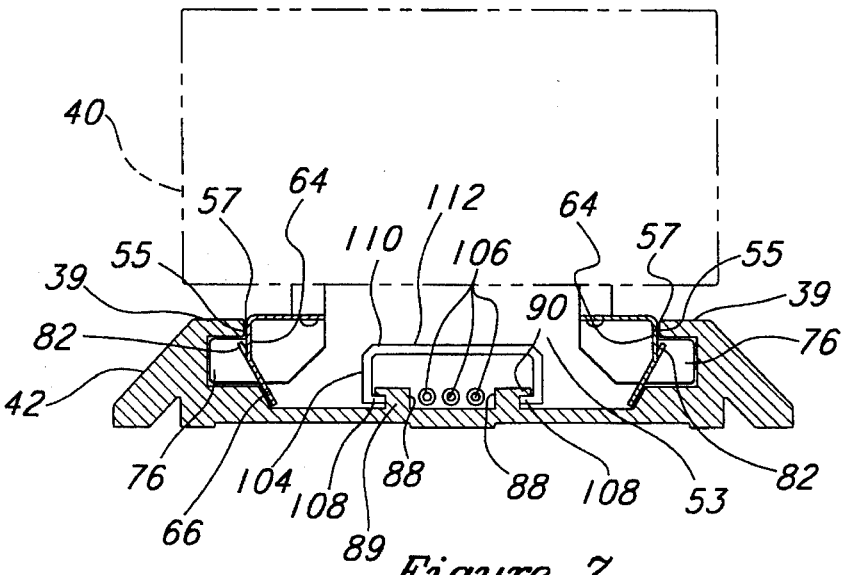
FIG. 7 is a bottom cross-sectional view of the apparatus of FIG. 6, including a cable retainer.

A pair of secondary tracks 88 extends upwardly from the forward surface 36 of the mounting plate, intermediate the tracks 34. Each of the secondary tracks 88 includes a forwardly extending leg 89 (FIG. 7) and a sideward lip 90 for attachment of a cable retainer 110, as shown in FIGS. 1 and 7. A rearward surface 32 of the mounting plate forms a generally flat surface for mounting to a wall. The mounting plate 42 is mounted, typically with its rearward surface flat against a wall, by bolting it through apertures 52 (FIG. 1 ) formed in the mounting plate.

Figure 2:
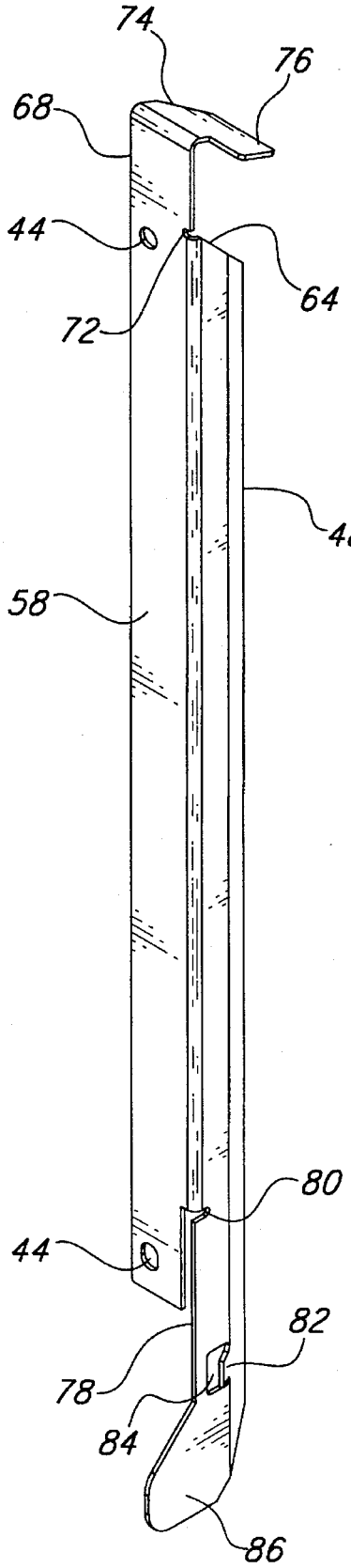
FIG. 2 is an isometric view of a mounting bracket according to the invention.
Figure 3:
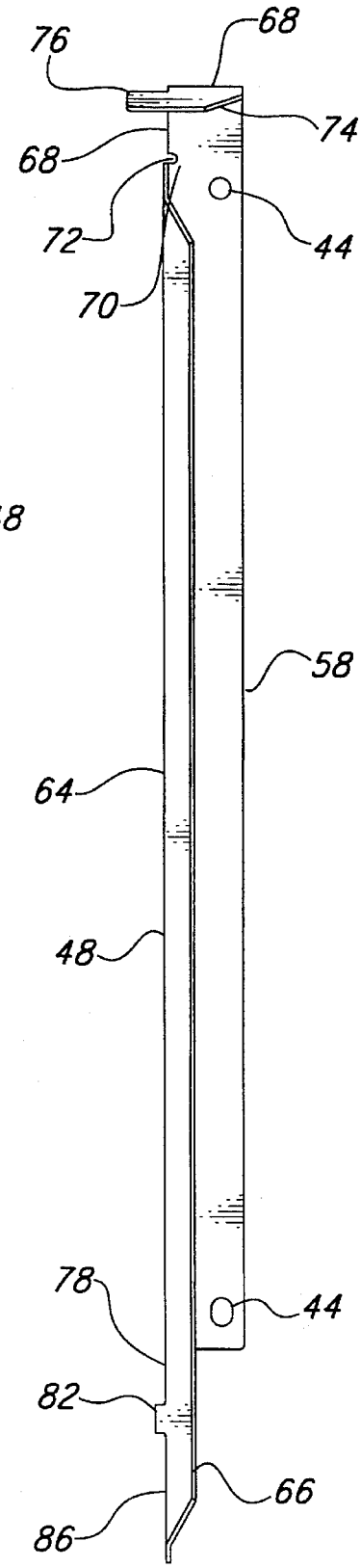
FIG. 3 is a side elevational view of the mounting bracket of FIG. 2.
Figure 4:
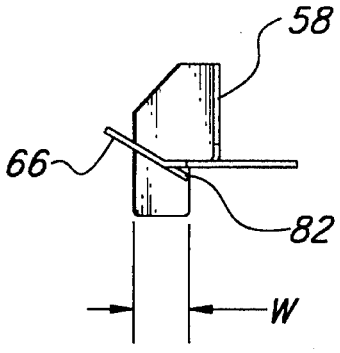
FIG. 4 is a bottom plan view of a mounting bracket according to the embodiment of FIG. 1 of FIG. 2.

Detachable connection of the electronic device 40 to the mounting plate 42 is achieved with the mounting brackets 46, 48, shown in more detail in FIGS. 2, 3 and 4. As shown in FIG. 1, the electronic device 40 is rigidly attached to each of the mounting brackets 46, 48 by screws 50 which engage threaded screw holes (not shown) in the electronic device 40. Other methods of attachment, such as bolts or clamps may be used. As will be described hereinafter, the mounting brackets 46, 48 engage the tracks 34 to rigidly hold the device to the mounting plate, as described below.

While the following discussion relates principally to the mounting bracket 48, it will be understood that the mounting bracket 46 is substantially a mirror image of the mounting bracket 48 and the following description will apply equally to the mounting bracket 46.

The mounting bracket 48 is preferably formed from a single, planar sheet of metal, typically stainless steel, using techniques known in the art. A base portion 58 of the mounting bracket contains mounting holes 44 for attachment of the mounting bracket to the electronic device. The principal engagement of the mounting bracket 46 to the tracks is achieved by mounting fingers 76 (FIG. 2) which project sidewardly to extend into the gap 37, as shown most clearly in the top view of FIG. 6.

Figure 8:
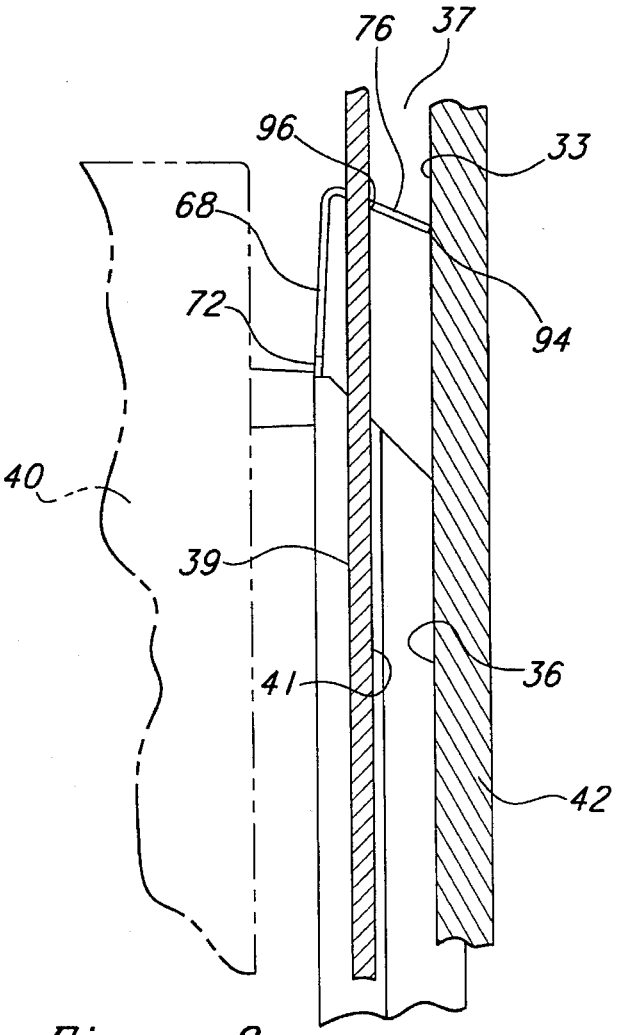
FIG. 8 is a detail of a side cross-sectional view of the embodiment of FIG. 1.

When the mounting finger 76 is positioned in the gap 37 between the inner surface 41 of the transverse leg 39 and the surface portion 33, it projects slightly downwardly, as seen most clearly in FIG. 8. A rearward edge 94 of the mounting finger 76 contacts the surface portion 33 and a forward edge 96 of the mounting finger 76 engages the inner surface 41 of the transverse leg 39. It will be understood that although a small gap is shown for clarity of presentation between the edges 94, 96 of the mounting finger 76 and both the inner surface 41 and surface portion 33, the mounting finger 76 actually contacts and "bites into" the inner surface 41 eliminating such small gap. The edges 94, 96 are forced into their respective surfaces, preventing the electronic device 40 from moving downwardly, much like a rock climber's foot wedged into a slot maintains the climber's position.

The slight downward angle of the mounting fingers 76 when they are positioned in the gap 37 advantageously creates a condition where the weight of the electronic device 40 provides additional torque to increase the frictional engagement of the edges 94, 96 to the tracks 34. As shown in FIG. 8, when the device 40 is mounted to the tracks 34, it applies a downward force along the tensioning arm 68. This force, in turn, pulls the forward edge 96 downwardly applying torque to make the mounting finger tend to pivot around the engagement of the rearward edge 94 to the surface portion 33. Because the width of the mounting finger 76 is greater than the wide of the gap 37, the mounting finger 76 is prevented from pivoting and the forward edge 96 is forced into greater frictional engagement with the inner surface 41.

Similarly, as the downward force of the electronic device 40 causes torquing of the mounting finger 76, it forces the rearward edge 94 toward greater frictional engagement with the surface portion 33. Thus, the greater the weight of the electronic device 40, the greater the frictional engagement of the mounting fingers 76 to the track 34, and the greater the support strength of the bracket 48.

Initial rotational bias of the mounting finger 76 to engage its forward and rearward edges 94, 96 to the inner surface 41 and surface portion 33 is provided by the tensioning arm 68 which extends upwardly from an upper end 70 of the base portion 58. The tensioning arms 68 are formed from planar extensions of the base portion with a relief cut 72 extending a short distance orthogonally through the planar extension. The relief cut permits the tensioning arms to flex to provide a spring-like effect to keep the mounting fingers 76 engaged to the tracks, as indicated by the slight bend about the relief cut, shown in FIG. 8. The length of the relief cut is selected to control the amount of force applied to the mounting fingers by the tensioning arm. Thus, even in the absence of the force from the electronic device 40, torque is applied by the flexed tensioning arm 68 to make the forward and rearward edges 94, 96 bite into the inner surface 41 and the surface portion 33.

With reference to FIGS. 2 and 3, the mounting bracket 48 further includes a lower tensioning arm 78 in which a retaining tab 82 is formed. The retaining tab 82 is formed from a small, sidewardly bent tab formed by cutting a U-shaped groove 84 (FIG. 2) in the lower tensioning arm 78 and bending the central portion formed by the cut sidewardly. The retaining tab 82 retains the mounting bracket in its mounted orientation, as described below. The lower tensioning arm 78 is a planar extension of the base portion, orthogonal to the tensioning arm 68 and is produced by a lower relief cut 80 (FIG. 2) which allows the lower tensioning arm 78 to flex. To permit a user to apply pressure to flex the lower tensioning arm, a pushpad 86 is incorporated at the end of the tensioning arm 78 by widening the planar piece forming the tensioning arm. When the push pad is pressed, the lower tensioning arm 78 bends and the tab is release from engagement with the tracks 34.

Figure 10:
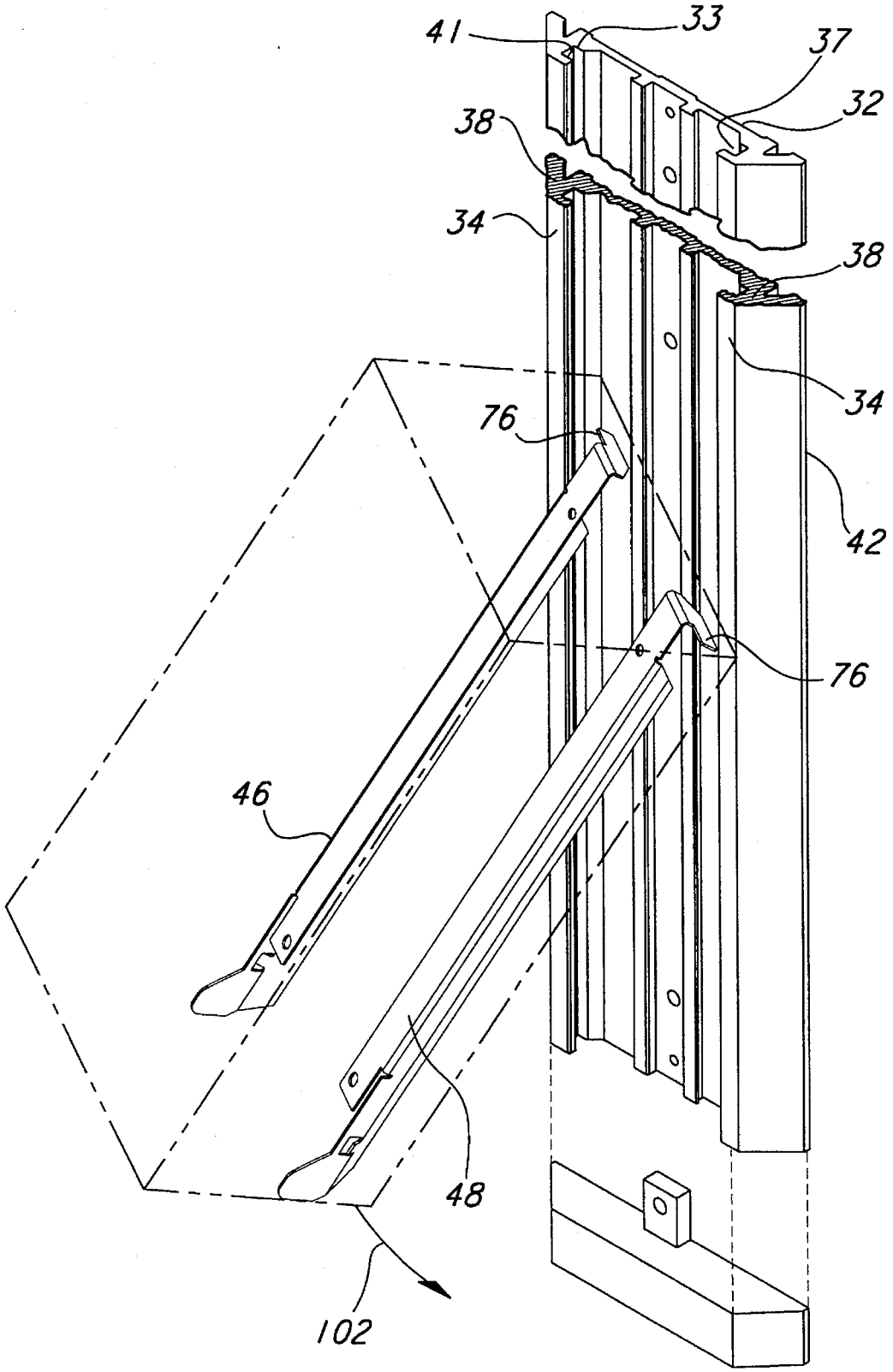
FIG. 10 is an isometric view of the mounting of the embodiment of FIG. 1.

As shown in FIG. 10, to achieve the positioning of FIGS. 7 and 8, the mounting bracket 48 is held with the mounting fingers 76 between the tracks and the lower end of the device 40 angled away from the wall with one of the mounting fingers 76 below the other. When the device 40 is in this position, the spacing between the tracks 34 is sufficient to insert the mounting fingers 76 between the transverse legs 39.

Figure 9:
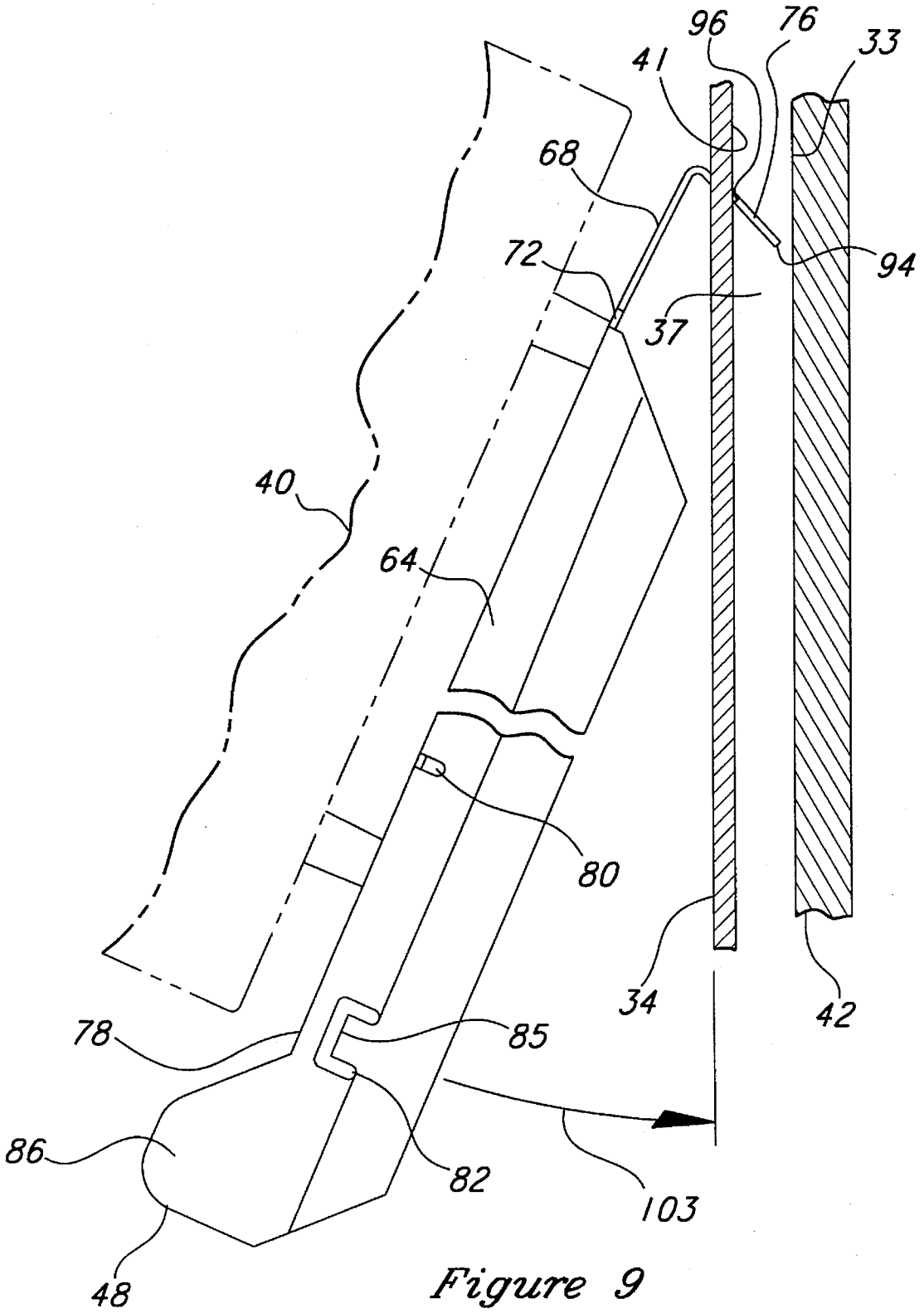
FIG. 9 is a detail of a side cross-sectional view of the mounting of the embodiment of FIG. 1.

The device 40 is then pivoted as indicated by the arrow 102 so that the mounting pieces 76 move into the gaps 37 with the lower end still angled away from the wall as seen most clearly in FIG. 9.

The lower end of device 40 is then pivoted toward the base 40 about the engagement of the forward edge 94 to the inner surface 41, as shown by the arrow 103 of FIG. 9. As the mounting bracket pivots toward the mounting plate 42, the rearward edge 96 of the mounting finger 76 meets the surface portion 33, preventing the mounting finger from rotating further. Further pivoting of the lower end of the device 40 toward the mounting plate 42 causes flexure of the tensioning arm 68 about the relief cut 72 until the mounting bracket 48 is aligned with the track 34. In this position, the device 40 is vertically aligned and the tensioning arms 68 are flexed, as shown in Figure 8.

The device 40 is prevented from rotating away from this position by the retaining tab 82 which extends sidewardly to engage the transverse leg 39 of the track 34 with its distal end 85, as is best seen in FIG. 7.

To demount the device 40, the retaining tab 82 is released from engagement with the inner surface 41 by applying pressure to force the pushpads 86 together, as can be seen most clearly in FIG. 1. This flexes the lower tensioning arm 78 about the lower relief cut 80. Release of the retaining tab 82 permits the lower end of the device 40 to be pivoted upwardly to release edges 94, 96 of the mounting finger from engagement with their respective surfaces 41, 33. The electronic device 40 is then rotated opposite the direction of the arrow 102 of FIG. 10 causing the mounting fingers 76 to exit the gaps 37. The device 40 is then free to be moved away from the mounting plate 42.

Figure 5:
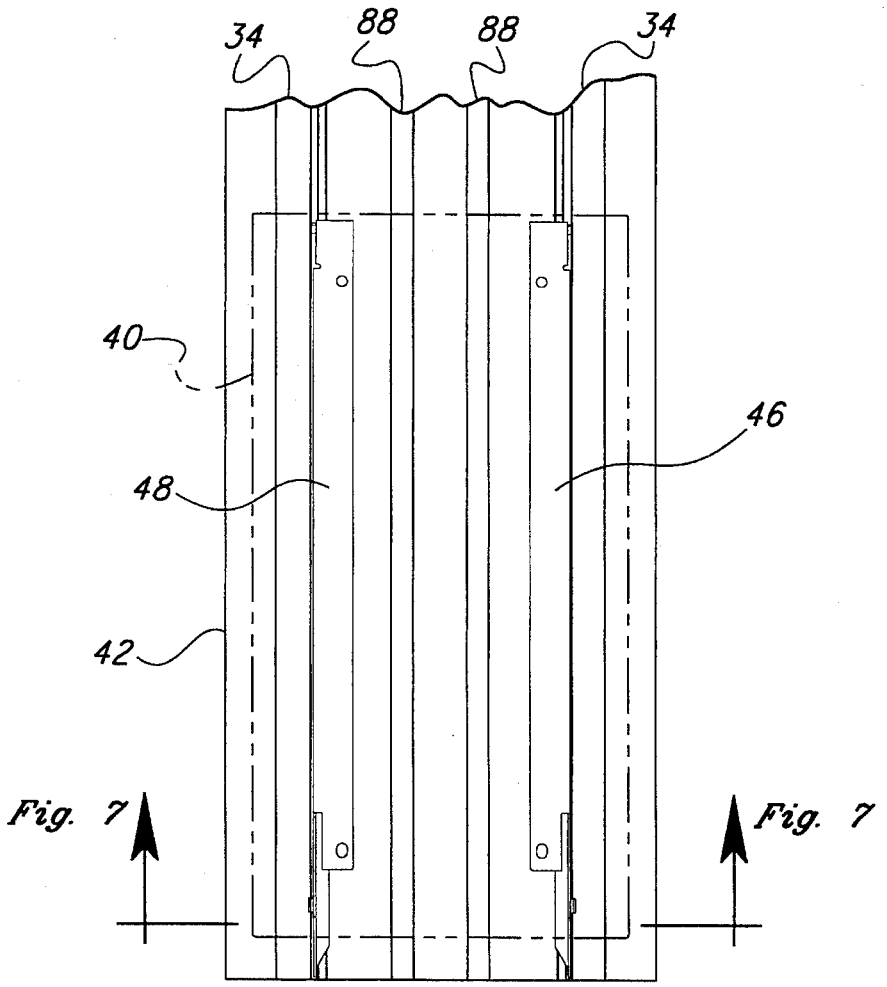
FIG. 5 is a top plan view of the embodiment of FIG. 1 with the brackets mounted to the mounting plate and the device removed.

The alignment piece 64, which is a planar section of the base portion 58 extending toward the mounting plate 42, aids in the mounting of the device 40. As can be seen in FIG. 5, as the lower end of the device 40 is rotated toward the mounting plate 42 (indicated by the arrow 103 of ]FIG. 9), the mounting brackets must be vertically aligned to pass between the transverse legs 39. The alignment piece 64 (FIG. 8) provides a surface to guide the mounting brackets 46, 48 into alignment with the transverse legs 39 as the device is rotated toward the base.

Figure 6:
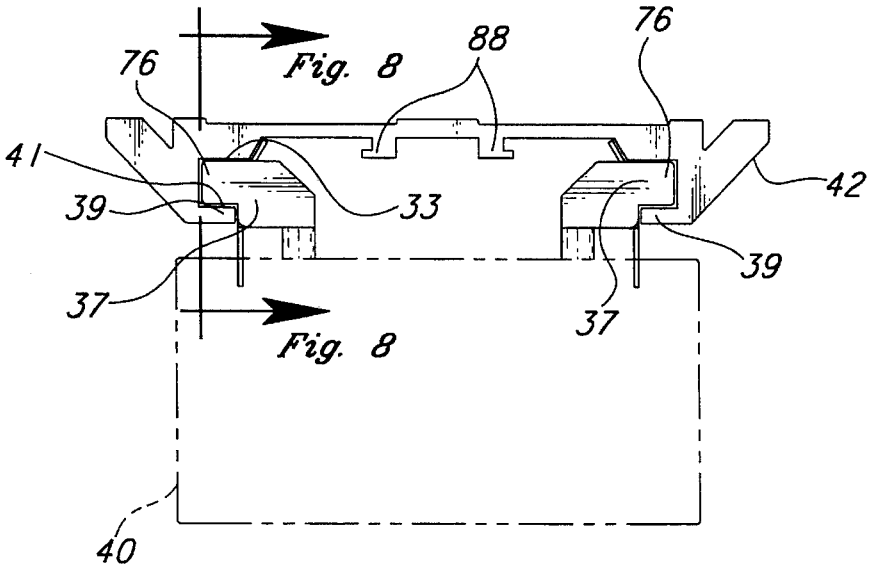
FIG. 6 is a top cross-sectional view showing the mounting configuration of the apparatus of FIG. 1.

A planar guide extension 66 (FIGS. 3 and 4) which extends at an angle of approximately 30° from the alignment piece 64 further eases alignment of the mounting brackets 46, 48 between the transverse legs 39. The guide extensions 66 o operate by providing a narrower section of the brackets 46, 48 to insert between the transverse legs 39. Once the guide extensions are between the transverse legs 39, their outer surface engage the transverse legs 39 and guide the mounting brackets into their proper alignment. Once the device 40 is rotated into its mounted position as shown in FIGS. 6, 7 and 8, the alignment pieces 64 prevent the mounting brackets 46, 48, and thus the device 40, from rotating in the direction indicated by the arrow 102 of FIGS. 1 and 10, thereby preventing the mounting fingers 76 from rotating free of the gap 37.

While the brackets 46, 48 have been found to support weights considerably greater than typical electronic devices such as medical monitors or power supplies, an endcap 54, shaped to conform to the general cross section of the base 42 mounts to a lower end 56 of the base and acts as a failsafe to prevent the device 40 from falling if the brackets should slip.

As shown in FIG. 1 and 7, the cable retainer 110 advantageously clips to the secondary tracks 88 to retain cables 106 between the device 40 and the mounting plate 42. The cable retainer is a flexible, C-shaped clip having retaining lips 108 (FIG. 7) at its outermost edges. The retaining lips 108 engage the sideward lips 90 of the secondary tracks 88. The cable retainer 110 is attached to the secondary tracks by flexing its central member 112 to separate the retaining lips 108 and permit them to pass around the sidemost edges of the sideward lips 90. When the central member 112 straightens, the retaining lips 108 move toward each other to a position between the sideward lips of the secondary tracks and the forward surface 36 of the mounting plate 42. When the cable retainer is attached to the secondary tracks, the cable retainer and the groove between the secondary tracks 88 form a passageway concealed from view by the mounted device 40. The concealed passageway permits electrical and other cables to reach the device without being visible while reducing tangling of the cables and other problems caused by freely hanging cables.

It will be apparent that many further modifications and variations may be effected without departing from the teachings and concepts of the present disclosure. The invention is therefore described by the claims appended hereto and is not restricted to the embodiments shown herein.

I claim:

1. A system for mounting an electronic instrument on a wall, comprising:

a mounting plate having a pair of parallel primary tracks, said mounting plate adapted for fastening to said wall with a rear surface of said mounting plate facing said wall, a forward surface of said mounting plate facing away from said wall, and with said primary tracks oriented vertically, each of said primary tracks being formed by a forwardly extending leg projecting from the forward surface of said mounting plate and a transversely extending leg projecting from the forward edge of said forwardly extending leg whereby an elongated track gap is formed between each transversely extending leg and the forward surface of said mounting plate; and a pair of mounting brackets each of which include:

(a) a base portion fastenable to the electronic instrument; and (b) a resilient mounting finger extending rearwardly and downwardly from its respective base portion when said mounting fingers are inserted in respective track gaps, each of said mounting fingers having a distance between forward and rear edges that causes said forward edge to contact the transversely extending leg of said primary track and said rear edge to contact the forward surface of the mounting plate when said mounting fingers are inserted into said track gaps with said electronic device projecting downwardly and forwardly away from said mounting plate whereby pivotal movement of said base portion toward said mounting plate about said mounting fingers causes the forward and rear edges of respective mounting tabs to frictionally engage the transversely extending legs of said primary track and the forward surface of said mounting plate, and downward forces exerted on said medical instrument impart a pivotal torque to said mounting fingers that increases the frictional engagement between the forward and rear edges of said mounting fingers and the transversely extending legs of said primary track and the forward surface of said mounting plate, respectively.

2. The system of claim 1 wherein said mounting brackets further include retaining tabs projecting from said base portion to engage said primary tracks to maintain said base portions adjacent respective primary tracks, thereby maintaining frictional engagement between said mounting fingers and said primary track.

3. The system of claim 2 wherein the base portion includes a mounting piece further comprising:

lower tensioning arms intermediate the mounting piece of said base portion and said retaining tabs; and push pads fixedly connected to each of said lower tensioning arms and positioned at a lower end of said lower tensioning arms such that pressure applied inwardly to said push pads causes said flexure of said lower tensioning arms for releasing said retaining tabs from engagement with said primary tracks.

4. The system of claim 3 wherein said base portion includes a mounting section further including a planar tensioning arm intermediate the mounting section of said base portion and said mounting finger and providing connection therebetween, said pivotal movement flexing said tensioning arm to cause said forward and rear edges of said mounting fingers to remain continuously frictionally engaged to the transversely extending legs of said primary tracks and the forward surface of said mounting plate, respectively.

5. The system of claim 1 wherein said mounting bracket further comprises planar guide walls projecting substantially rearwardly from said base portion, said guide walls being oriented substantially vertically when said bracket is mounted to said mounting plate, a sideward surface of said guide walls engaging an edge of said plate to prevent sideward rotation of said bracket, retaining said mounting fingers in said track gap.

6. The system of claim 5 wherein said brackets further include planar curved extensions of said guidewalls, each curved extension curving away from said retaining tab to provide a guiding surface for aligning said guidewalls to said primary tracks.

7. The system of claim 6 wherein said mounting brackets further include retaining tabs projecting from said base portion to engage said primary tracks to maintain said base portions adjacent respective primary tracks, thereby maintaining frictional engagement between said mounting fingers and said primary track.

8. The system of claim 7 further comprising:

lower tensioning arms intermediate a mounting piece of said base portion and said retaining tabs; and push pads fixedly connected to each of said lower tensioning arms and positioned at a lower end of said lower tensioning arms such that pressure applied inwardly to said push pads causes said flexure of said lower tensioning arms for releasing said retaining tabs from engagement with said primary tracks.

9. The mounting bracket of claim 8 wherein said base portion includes a mounting section further including a planar tensioning arm intermediate the mounting section of said base portion and said mounting finger and providing connection therebetween, said pivotal movement flexing said tensioning arm to cause said forward and rear edges of said mounting fingers to remain continuously frictionally engaged to the transversely extending legs of said primary tracks and the forward surface of said mounting plate, respectively.

10. The mounting bracket of claim 8 wherein said mounting bracket further comprises planar guide walls projecting substantially rearwardly from said base portion, said guide walls being oriented substantially vertically when said bracket is mounted to said mounting plate, a sideward surface of said guide walls engaging an edge of said plate to prevent sideward rotation of said bracket, thereby retaining said mounting fingers in said gap.

11. The system of claim 1, further comprising;

a pair of parallel secondary tracks intermediate said primary tracks and spaced apart by a predetermined distance, each of said secondary tracks being formed by a rail extending forwardly from said mounting plate and having a transversely extending lip projecting from forward edge of said rail; and a retaining clip mountable to said secondary tracks, said retaining clip including a pair of opposed arms interconnected by a resilient center piece and projecting rearwardly from said center piece, each of said opposed arms including a groove at its rearward end for engaging its respective lip to retain said retaining clip to said mounting plate.

12. The mounting bracket of claim 11 wherein said mounting brackets further include retaining tabs projecting from said base portion to engage said tracks to maintain said base portions adjacent respective tracks, thereby maintaining frictional engagement between said mounting fingers and said track.

13. The mounting bracket of claim 12 wherein said brackets further include planar curved extensions of said guidewalls, each curved extension curving away from said retaining tab to provide a guiding surface for aligning said guidewalls to said tracks.

14. A mounting bracket formed from a single planar sheet for mounting a medical device to a mounting plate, the mounting plate having a pair of vertically oriented parallel tracks extending forwardly from a forward surface of the mounting plate, the tracks include a forwardly extending leg projecting from said forward surface and a transversely extending leg projecting from a forward edge of said forwardly extending leg, whereby an elongated track gap is formed between each transversely extending leg and the forward surface of the mounting plate, comprising:

a base portion fastened to the medical component; and a resilient mounting finger extending rearwardly and downwardly from its respective base portion when said mounting fingers are inserted in respective track gaps, each of said mounting fingers having a distance between forward and rear edges that causes said forward edge to contact the transversely extending leg of said track and said rear edge to contact the forward surface of said mounting plate when said mounting fingers are inserted into said track gaps with said electronic device projecting downwardly and forwardly away from said mounting plate whereby pivotal movement of said base portion toward said mounting plate about said mounting fingers causes the forward and rear edges of respective mounting tabs to frictionally engage the transversely extending legs of said track and the forward surface of said mounting plate, and downward forces exerted on said medical instrument impart a pivotal torque to said mounting fingers that increase the frictional engagement between the forward and rear edges of said mounting fingers and the transversely extending legs of said track and the forward surface of said mounting plate, respectively.

15. The mounting bracket of claim 14 wherein the base portion includes a mounting section further comprising:

lower tensioning arms intermediate the mounting section of said base portion and said retaining tabs; and push pads fixedly connected to each of said lower tensioning arms and positioned at a lower end of said lower tensioning arms such that pressure applied inwardly to said push pads causes said flexure of said lower tensioning arms for releasing said retaining tabs from engagement with said tracks.

16. The system of claim 15 wherein said mounting brackets further include retaining tabs projecting from said base portion to engage said tracks to maintain said base portions adjacent respective tracks, thereby maintaining frictional engagement between said mounting fingers and said track.

* * * * *